US012692782B2

(12) United States Patent
Maclean et al.

(10) Patent No.: US 12,692,782 B2
(45) Date of Patent: Jul. 28, 2026

(54) HANGING PRODUCTION LOGGING TOOLS BELOW A CABLE DEPLOYED ELECTRIC SUBMERSIBLE PUMP

(71) Applicant: Schlumberger Technology Corporation, Sugar Land, TX (US)

(72) Inventors: Iain Maclean, Aberdeen (GB); Rubria Garza, Aberdeen (GB); Robert Loov, Aberdeen (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/097,897

(22) Filed: Apr. 2, 2025

(65) Prior Publication Data

US 2025/0314168 A1 Oct. 9, 2025

(30) Foreign Application Priority Data

Apr. 3, 2024 (GB) ..... 2404758

(51) Int. Cl.

| | |
|---|---|
| ***E21B 47/10*** | (2012.01) |
| ***E21B 23/00*** | (2006.01) |
| ***E21B 43/12*** | (2006.01) |
| ***E21B 47/017*** | (2012.01) |
| ***E21B 47/07*** | (2012.01) |

(52) U.S. Cl.

CPC ..... *E21B 47/10* (2013.01); *E21B 23/00* (2013.01); *E21B 43/128* (2013.01); *E21B 47/017* (2020.05); *E21B 47/07* (2020.05)

(58) Field of Classification Search

CPC ..... E21B 47/10; E21B 23/00; E21B 43/128; E21B 47/017; E21B 47/07

See application file for complete search history.

(56) References Cited

U.S. PATENT DOCUMENTS 6,394,184 B2 * 5/2002 Tolman ..... E21B 47/04 166/308.1
10,036,210 B2 7/2018 Maclean et al.
(Continued)

FOREIGN PATENT DOCUMENTS

EP 4575177 A1 * 6/2025 ..... E21B 43/12
GB 9923870 4/2001
(Continued)

OTHER PUBLICATIONS

IPO exam report (Year: 2024).*
IPO search report (Year: 2024).*

*Primary Examiner* — Steven A MacDonald
(74) *Attorney, Agent, or Firm* — Kyle R. Miiller

(57) ABSTRACT

A method for characterizing fluid production into a well during pumping fluid from the well includes deploying a well pump on an electrical cable to a selected depth in a production tubing nested within a protective pipe in the well. The well pump has suspended therefrom an extension line. The extension line is connected at an end opposed to the well pump at least one production logging sensor. A length of the extension line is chosen such that the at least one production logging sensor is disposed in the protective pipe below a bottom of the production tubing. The well pump is operated; and while operating the well pump, at least one property of fluid entering the protective pipe is measured using the at least one production logging sensor.

7 Claims, 5 Drawing Sheets

(56) References Cited

U.S. PATENT DOCUMENTS

| | | | | |
|---|---|---|---|---|
| 12,215,579 | B1 * | 2/2025 | Cochran | E21B 43/128 |
| 2006/0225881 | A1 * | 10/2006 | O'Shaughnessy | E21B 47/07 166/250.07 |
| 2007/0295502 | A1 * | 12/2007 | Watson | E21B 43/128 166/254.2 |
| 2008/0311776 | A1 * | 12/2008 | Cox | E21B 47/00 166/313 |
| 2009/0084543 | A1 | 4/2009 | Fitzgerald | |
| 2009/0277628 | A1 | 11/2009 | Watson et al. | |
| 2012/0211240 | A1 | 8/2012 | Xiao et al. | |
| 2013/0062055 | A1 * | 3/2013 | Tolman | E21B 43/116 175/4.51 |
| 2016/0215578 | A1 * | 7/2016 | Adnan | E21B 23/01 |
| 2018/0045045 | A1 * | 2/2018 | Castillo | E21B 47/12 |
| 2018/0073353 | A1 * | 3/2018 | Malik | E21B 47/107 |
| 2019/0106948 | A1 | 4/2019 | O'Grady et al. | |
| 2021/0381327 | A1 * | 12/2021 | Ejim | E21B 43/128 |
| 2022/0148761 | A1 * | 5/2022 | Crane | F04D 13/0693 |

FOREIGN PATENT DOCUMENTS

| | | | | |
|---|---|---|---|---|
| WO | 2009113894 | A1 | 9/2009 | |
| WO | 2009113895 | A1 | 9/2009 | |
| WO | WO-2015163781 | A1 * | 10/2015 | E21B 47/07 |
| WO | 2025137418 | A1 | 6/2025 | |

* cited by examiner

HANGING PRODUCTION LOGGING TOOLS BELOW A CABLE DEPLOYED ELECTRIC SUBMERSIBLE PUMP

CROSS-REFERENCE TO RELATED APPLICATIONS

The current application claims priority to United Kingdom Patent Application No. 2404758.1, filed Apr. 3, 2024, the entirety of which is incorporated by reference.

BACKGROUND

This disclosure relates to the field of electric submersible well pumps (ESPs). More particularly, the disclosure relates to using ESPs to "kick start" a well and to characterize producing subsurface formations penetrated by the well as to their contributions to fluid production from the well while an ESP is used.

U.S. Pat. No. 10,036,210 issued to Maclean et al. discloses a method for deploying an electric submersible pump (ESP) into a subsurface well using an electrical cable. It is known in the art to deploy ESPs with or assembled to an annular seal, e.g., a packer, to close an annular space between the ESP and a conduit in the well, so that fluid lifted by the ESP is constrained to move within the conduit to surface.

ESPs may be used in some cases to "kick start" a well by lifting liquid, e.g., water from the well to reduce hydrostatic pressure against hydrocarbon bearing formations adjacent to the well, thus enabling flow of hydrocarbons into the well.

In some cases, it may be desirable to measure flow rates and water/oil/gas fraction ("holdup") at various depths within a well to obtain better understanding of which depth interval(s) are productive of hydrocarbons and which may be productive of water (which can be undesirable because of the resulting hydrostatic pressure). Measuring instruments known as production logging tools are used to make such measurements. It is desirable to be able to make such measurements while using an ESP, particularly where the ESP may be moved and operated at various depths in the well.

It is frequently the case that a well has a plurality of longitudinally spaced apart formations or zones within a formation hydraulically connected to the well, e.g., by perforations made in a protective pipe (liner or casing) disposed in the well, while the ESP having a resettable or other annular seal (packer) is arranged such that the packer is settable in a pipe string (production tubing) nested within the protective pipe. The production tubing has a smaller internal diameter than the protective pipe and is provided to increase velocity of fluid flowing to surface to enable, e.g., entraining liquids such as water or oil within the fluid flow stream to minimize hydrostatic head against the producing formation(s). A limitation to using production logging tools when attached directly to the ESP is that there are no readily available packers that can pass through the production tubing, and seal against the protective pipe (liner or casing) so as to be able to deploy the production logging tools proximate each zone or formation.

There is a need for methods and devices to deploy a pump, e.g., an ESP, in a well wherein production logging tools may be deployed in the protective pipe below the production tubing in order to characterize fluid entering the well from the one or more zones or formations in communication with the well.

SUMMARY

One aspect of the present disclosure is a method for characterizing fluid production into a well during pumping fluid from the well. A method according to this aspect includes deploying a well pump on an electrical cable to a first selected depth in a production tubing nested within a protective pipe in the well. The well pump has suspended therefrom an extension line. The extension line is connected at an end opposed to the well pump at least one production logging sensor. A length of the extension line is chosen such that the at least one production logging sensor is disposed in the protective pipe below a bottom of the production tubing. The well pump is operated; and while operating the well pump, at least one property of fluid entering the protective pipe is measured using the at least one production logging sensor.

In some embodiments, the extension line has a fixed length.

Some embodiments further comprise switching the well pump off, moving the well pump to a second selected depth in the production tubing, operating the well pump and while operating the well pump measuring the at least one property of the fluid entering the protective pipe using the at least one production logging sensor.

In some embodiments, deploying the well pump at the first selected depth comprises engaging an annular seal between the well pump and the production tubing.

In some embodiments, the at least one production logging sensor comprises a flow meter.

In some embodiments, the flow meter comprises at least one of a spinner flow meter, an orifice flow meter, a venturi flow meter, a hotwire anemometer, a cross correlation flow meter, an optical flow meter or a Coriolis effect flow meter.

In some embodiments, the at least one production logging sensor comprises a holdup meter.

In some embodiments, the holdup meter comprises at least one of a capacitance sensor, a density sensor, an acoustic velocity, an attenuation sensor or an optical sensor.

In some embodiments, the first selected depth and a length of the extension line are chosen such that the production logging sensor is located above a set of perforations in the protective pipe.

Some embodiments further comprise changing a length of the extension line so as to position the at least one production logging sensor at a second selected depth in the protective pipe below a bottom of the production tubing, and continuing operating the pump and measuring the at least one property of the fluid entering the protective pipe using the at least one production logging sensor.

In some embodiments, the second selected depth comprises a position above a set of perforations adjacent a formation or zone different than a formation or zone associated with the first selected depth.

In some embodiments, the extension line comprises an optical fiber.

In some embodiments, the at least one production logging sensor comprises a temperature sensor and/or an acoustic sensor forming part of or associated with the optical fiber.

In some embodiments, the at least one production logging sensor comprises a distributed acoustic sensor and/or distributed temperature sensor forming part of the optical fiber.

An apparatus for lifting fluid from a well and obtaining measurements of at least one property of the fluid according to another aspect of the present disclosure includes a tool assembly disposed in a housing adapted to traverse an interior of a production tubing in the well. The tool assembly comprises a pump having an inlet and an outlet. The tool assembly comprises a resettable annular seal disposed between the inlet and the outlet and an extension line functionally coupled at one end to a longitudinal end of the housing. At least one production logging sensor is coupled to an opposed end of the extension line.

Some embodiments further comprise a winch couped to the longitudinal end of the housing and having wound thereon the extension line, the winch arranged to extend and retract the extension line to change a distance between the tool assembly housing and the at least one production logging sensor.

In some embodiments, the tool assembly comprises an electric motor, a downhole monitoring sensor package, a pump rotationally coupled to an output of the electric motor and a protector disposed between the motor and the pump.

In some embodiments, the extension line is electrically connected to the downhole monitoring sensor package to provide electrical power to and to communicate signals from the at least one production logging sensor.

In some embodiments, the at least one production logging sensor comprises a flow meter.

In some embodiments, the flow meter comprises at least one of a spinner flow meter, an orifice flow meter, a venturi flow meter, a hotwire anemometer, a cross correlation flow meter, an optical flow meter or a Coriolis effect flow meter.

In some embodiments, the at least one production logging sensor comprises a holdup meter.

In some embodiments, the holdup meter comprises at least one of a capacitance sensor, a density sensor, an acoustic velocity, an attenuation sensor or an optical sensor.

In some embodiments, the extension line comprises slickline, and the at least one production logging sensor comprises a recording device to record measurements made by the at least one production logging sensor.

In some embodiments, the extension line comprises at least one insulated electrical conductor.

In some embodiments, the extension line comprises an optical fiber.

In some embodiments, the at least one production logging sensor comprises a temperature sensor and/or an acoustic sensor forming part of or associated with the optical fiber.

In some embodiments, the at least one production logging sensor comprises a distributed acoustic sensor and/or distributed temperature sensor forming part of the optical fiber.

Other aspects and possible advantages will be apparent from the description and claims that follow.

DETAILED DESCRIPTION

Figure 1:
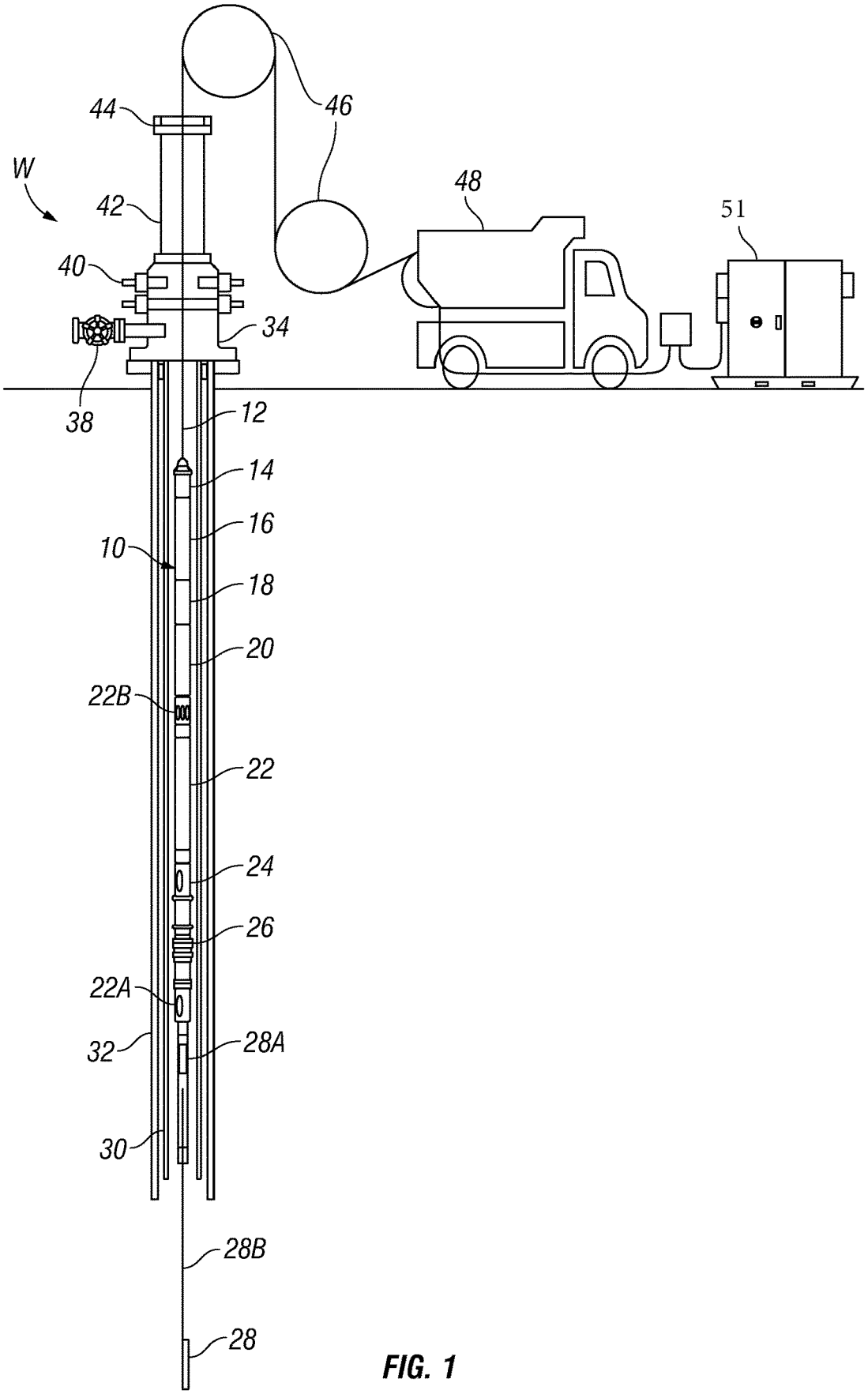
FIG. 1 shows an example embodiment of a well pump system deployed in a well using an electrical cable, including a production logging tool suspended below the pump system by an extension line.

FIG. 1 shows an example embodiment of a well pump and tool assembly ("assembly") 10 in accordance with, and that may be used with methods according to the present disclosure. The assembly 10 may be deployed in a subsurface well W drilled through various underground earthen formations (not shown in FIG. 1; see FIGS. 2 through 10). The well W may comprise a protective pipe 32, e.g., a liner or casing extending from a valve assembly ("wellhead") 34 coupled to a surface end of the protective pipe 32. A string of smaller diameter conduit ("production tubing") 30 may be nested within the protective pipe 32 and provide a smaller cross section conduit to increase the velocity at which fluids move to the surface to facilitate fluid production, e.g., by entraining higher density fluids such as water within the flow of lower density fluids such as oil and/or gas. It will be appreciated that if the protective pipe 32 does not extend back to the wellhead 34, and is nested within a larger protective pipe that does extend back to surface or to a shallower intermediate depth within the well W, the protective pipe 32 may be known as a liner. The term "casing" as used herein is intended to mean both a to-surface extending protective pipe and what is otherwise referred to as a liner.

The wellhead 34 may comprise one or more valves, e.g., at 38 to enable fluids moving up the production tubing 30 to leave the well W in a controlled manner. When well intervention devices such as the assembly 10 are moved into a well, safety considerations usually require that a pressure control device such as a blowout preventer (BOP) stack 40 is coupled above the wellhead 34 to provide positive closure of the well W in the event uncontrolled flow of fluid into the well takes place. A conduit called a lubricator 42 may couple to the top of the BOP stack 40 to provide a sealed enclosure for the assembly 10 in order to introduce the assembly 10 into the well W so as to prevent the interior of the well W from being exposed at any time. A pack off or grease injection head 44 may be used to seal against an electrical cable 12 used to deploy the assembly 10 in the well W, while enabling movement of the electrical cable 12 and thereby the assembly 10 along the well W as may be needed.

The electrical cable 12 may transmit electrical power to operate the assembly 10 and may communicate signals from various measuring instruments associated with the assembly 10 as it is operated in the well W. The electrical cable 12 may be extended from and retracted onto a winch 48 of types well known in the art in order to move the assembly in the well W. A surface end of the electrical cable 12 may be electrically connected to a surface system 51 of types well known in the art used in connection with electric submersible pumps (ESPs). The surface system 51 may comprise pump speed control devices such as a variable frequency drive. The electrical cable 12 may pass through one or more sheaves 46 between the winch 48 and the well W in order to direct the electrical cable 12 properly to move the assembly 10 freely along the interior of the well W.

The assembly 10 may be coupled to the electrical cable 12 by a cable head 14 of types well known in the art. The assembly 10 may comprise an electric motor 16 such as a permanent magnet motor rotationally coupled, through a protector assembly 20 and a sensor package 18 to a pump 22 such as a centrifugal pump. An inlet 22A to the pump 22 may be disposed proximate a lower end of the assembly 10, at least disposed below a resettable annular seal ("packer") 26 disposed along the assembly 10. A discharge 22B of the pump 22 may be disposed on an opposed axial side of the resettable packer 26. Thus, flow from the pump 22 is constrained to move upwardly in the production tubing 30 when the resettable packer 26 is expanded within the production tubing 30. A bypass valve 24 may be provided in the assembly 10 for circumstances wherein flow from parts of the well W below the resettable packer 26 exceeds the flow rate of the pump 22. Such flow may move through the bypass valve 24 upwardly through the production tubing 30.

The resettable packer 26 may comprise a J-slot mechanism (not shown) to set the packer 26 in a desired axial position in the production tubing 30. The J-slot mechanism may be operated by lifting and lowering the electrical cable 12. A seal element (not shown) in the resettable packer 26 may be energized using the weight of the assembly 10 alone, that is, to activate the seal element (not shown) the electrical cable 12 is unspooled from the winch 48 after the J-slot mechanism sets, such that weight of the assembly 10 will be applied to the resettable packer 26 to activate the seal element (not shown). When it is desired to release the resettable packer 26 to move the assembly 10, the electrical cable 12 may be spooled onto the winch 48 to lift the assembly and relieve weight from the resettable packer. The resettable packer 26 may be configured to resist forces bi-directionally, preventing differential pressure (blow-out) caused or other unwanted movement of the assembly 10 along the production tubing 30. The resettable packer 26 may be configured to resist blowout, e.g., by providing additional gripping elements ("slips") to engage the interior of the production tubing 30 when the resettable packer 26 is released (unset) if naturally produced fluid causes sufficient upthrust on the assembly 10. The resettable packer 26 in some embodiments may comprise any mechanism to radially expand gripping elements (not shown separately) arranged to axially lock the assembly 10 into position within the production tubing 30, and to actuate the seal element, that is not operated by fluid pressure (i.e., an inflatable packer).

In some embodiments, one or more production logging sensors 28 may be coupled to the assembly 10 in a way to provide substantial longitudinal spacing between the bottom of the assembly 10 and the production logging sensors 28. In some embodiments, the assembly 10 may comprise an adapter 28A coupled to the bottom thereof, to make electrical (and/or optical) and mechanical connection to an extension line 28B, which in the present embodiment may be an electrical cable having one or more insulated electrical conductors, extending from the adapter 28A in a direction away from the bottom of the assembly 10. In some embodiments, the extension line 28B may omit any electrical conductors and may be used only to make mechanical connection between the assembly 10 and the production logging sensors 28, e.g., slickline. The production logging sensors 28 may be coupled to the other end of the extension line 28B. A length of the extension line 28B may be selected or adjusted, as will be explained further below, to enable placement of the production logging sensors 28 proximate one or more formations or zones in the well below the bottom of the production tubing 30, while the assembly 10 is deployed within and the resettable packer engaged with the production tubing 30. In some embodiments, as will be explained with reference to FIGS. 12 through 15, the extension line 28B may comprise an optical fiber with or without electrical conductors.

The production logging sensors 28 may comprise, for example, and without limitation, one or more types of flow meter, e.g., a spinner flow meter, an orifice flow meter, a venturi flow meter, a hotwire anemometer, a cross correlation flow meter, an optical flow meter or a Coriolis effect flow meter. The production logging sensors 28 may also comprise one or more types of fluid fraction sensors, known as "holdup" meters. Holdup meters may comprise, for example and without limitation, capacitance sensors to determine fractional volume of oil or water in liquid, density sensors to determine fractional volume of liquid or gas in a fluid, or acoustic velocity, optical and/or attenuation sensors. In some embodiments, the production logging sensors 28 may be battery operated and may internally record measurements made by the various sensors for interrogation when the assembly 10 is removed from the well W. In some embodiments, the extension line 28B may comprise one or more insulated electrical conductors to enable communication of electrical power and signals along the extension line 28B.

Figures 2, 3, 4, 5, 6:
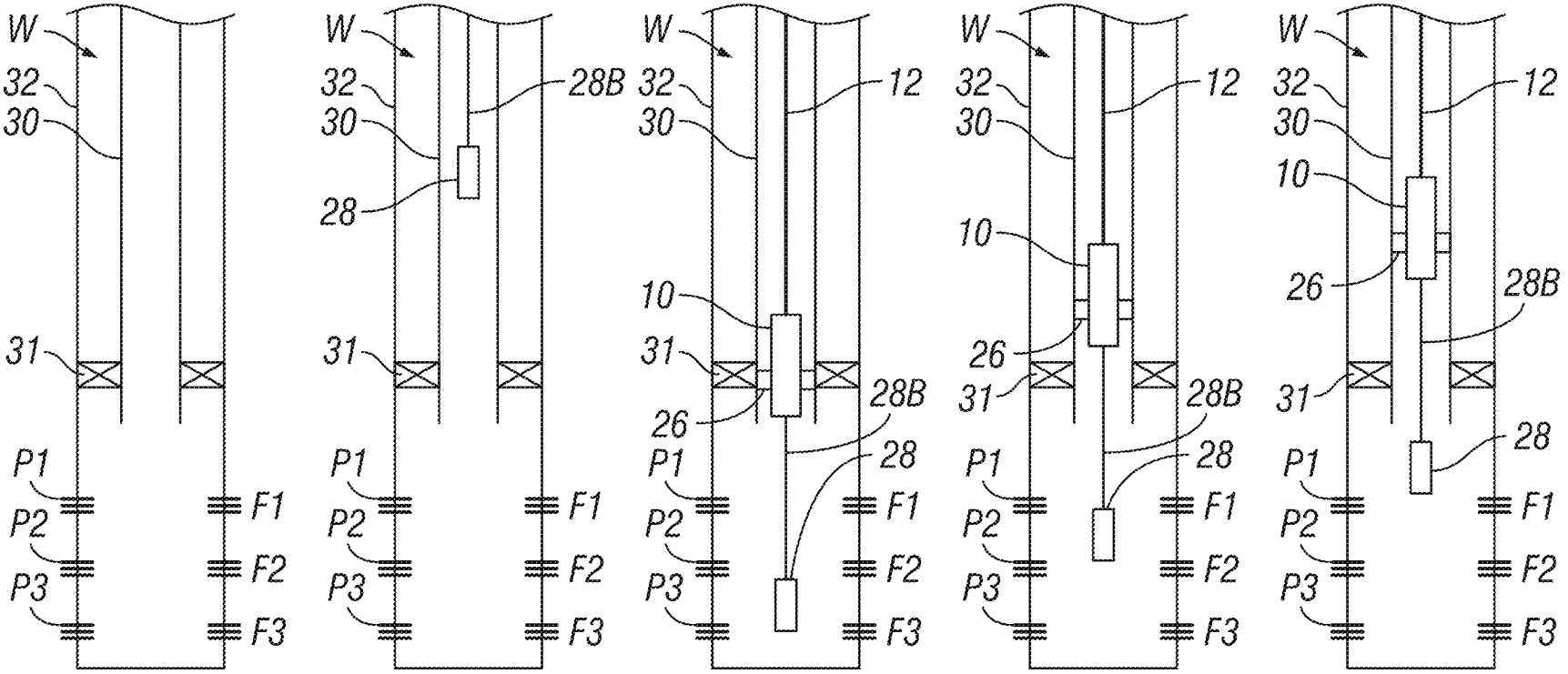
FIGS. 2 through 6 show an example embodiment of a pump and production logging tool apparatus being deployed in a well to both pump the well and to characterize fluid flow from longitudinally spaced apart zones in communication with the well.

FIGS. 2 through 6 show an example embodiment of deployment of the assembly 10 and the production logging sensors 28. FIG. 2 shows the well W prior to deployment of the assembly 10 and production logging sensors 28. The well W may penetrate a plurality of spaced apart formations or zones F1, F2, F3 all of which are in hydraulic communication with the interior of the protective pipe 32 (in this instance a casing but the present disclosure is not so limited) through, e.g., depth-corresponding perforations P1, P2, P3 in the protective pipe 32.

FIG. 3 shows the production logging sensors 28 attached to the extension line 28B being lowered into the well W inside the production tubing 30. An annular seal 31 such as a packer may be used to seal the annular space between the protective pipe 32 and the production tubing 30 such that fluid entering the protective pipe 32 from below the bottom of the production tubing 30 is constrained to flow within the production tubing 30.

FIG. 4 shows the assembly 10 disposed in the production tubing 30 such that the production logging sensors 28 are located proximate (e.g., just above in depth) the lowermost perforations P3. The resettable packer 26 may be locked in place to keep the assembly 10 at the specific depth and to seal the annular space between the assembly 10 and the interior of the production tubing 30. The pump (22 in FIG. 1) may be operated to lift fluid from the well W. Simultaneously, the production logging sensors 28 may be operated in order to obtain measurements related to flow rate and composition of fluids entering the protective pipe 32 through the lowermost perforations P3.

In FIG. 5, the assembly 10 has been moved within the production tubing 30 and then re-set (by resetting the resettable packer 26) at a shallower depth such that the production logging sensors 28 are disposed proximate to (e.g., just above) the intermediate perforations P2. Operating the pump (22 in FIG. 1) may be repeated, and the production logging sensors 28 may be operated to obtain measurements in the same way as explained above.

In FIG. 6, the foregoing moving and re-setting have been repeated wherein the production logging sensors 28 are deployed proximate to (e.g., just above) the shallowest perforations P1. It will be appreciated that the number of separate zones or formations in communication with any particular well and the number of movements and re-sets is not a limitation on the scope of the present disclosure.

It will be appreciated that using a fixed length extension line 28B as explained with reference to FIGS. 2 through 6 may in some instances prove to by inconvenient. First, to deploy the production logging sensors 28 different depths in the well as explained with reference to FIGS. 2 through 6 requires releasing the resettable packer 26, moving the assembly 10 and then once again setting the resettable packer 26. Second, in cases where the selected length of the extension line 28B is great, deploying the production logging sensors 28 and the assembly 10 while maintaining full pressure control of the well W as explained with reference to FIG. 1 may require, for example, use of specific pressure control apparatus such as a rod lock blowout preventer (BOP) to sealingly engage the extension line 28B while the lubricator 42 and packoff 44 are removed to enable the assembly 10 to be coupled to the end of the extension line 28B.

It will be appreciated that using a fixed length extension line 28B as explained with reference to FIGS. 2 through 6 may in some instances prove to be inconvenient. First, to deploy the production logging sensors 28 at different depths in the well as explained with reference to FIGS. 2 through 6 requires releasing the resettable packer 26, moving the assembly 10 and then once again setting the resettable packer 26. Second, in cases where the selected length of the extension line 28B is great, deploying the production logging sensors 28 and the assembly 10 while maintaining full pressure control of the well W as explained with reference to FIG. 1 may require, for example, use of specific pressure control apparatus such as a rod lock blowout preventer (BOP) to sealingly engage the extension line 28B while the lubricator 42 and grease injection head 44 are removed to enable the assembly 10 to be coupled to the end of the extension line 28B.

Figure 8:
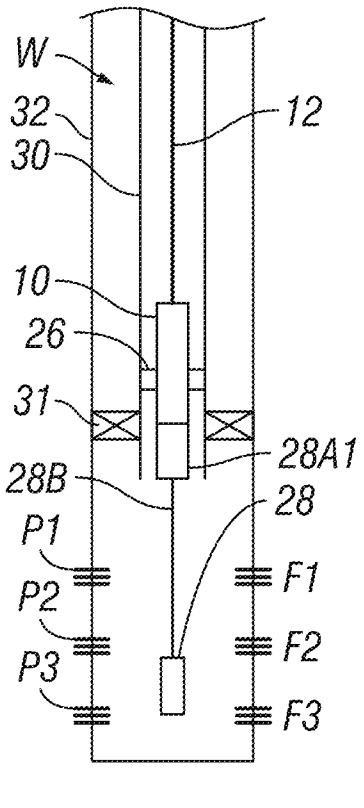
Figure 7:
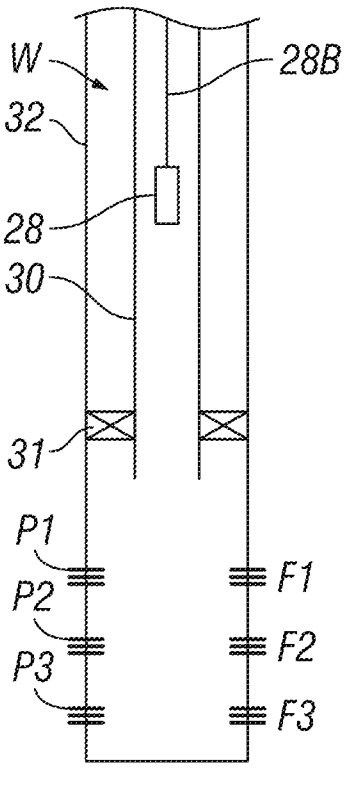

FIG. 7 shows the production logging sensors 28 suspended at the end of the extension line 28B, which has been extended from the winch or spool (28A1 in FIG. 8); in FIG. 8 the assembly 10 and winch/spool 28A1 are shallower in the well than the view in FIG. 7. Structure of the well W, the perforations P1, P2, P3, formations F1, F2, F3, protective pipe 32, annular seal 31 and production tubing 30 may be substantially as explained with reference to FIGS. 2 through 6 for purposes of explaining the present example embodiment; any actual implementation is not so limited.

In FIG. 8, the assembly 10 has reached the intended deployment depth for the pump (22 in FIG. 1) and the resettable packer 26 is operated to engage the production tubing 30 as explained elsewhere herein. The winch 28A1 may be operated as necessary to position the production logging sensors 28 proximate, e.g., just above the lowermost perforations P3. The production logging sensors 28 may be operated to obtain measurements as explained with reference to FIG. 4.

Figure 9:
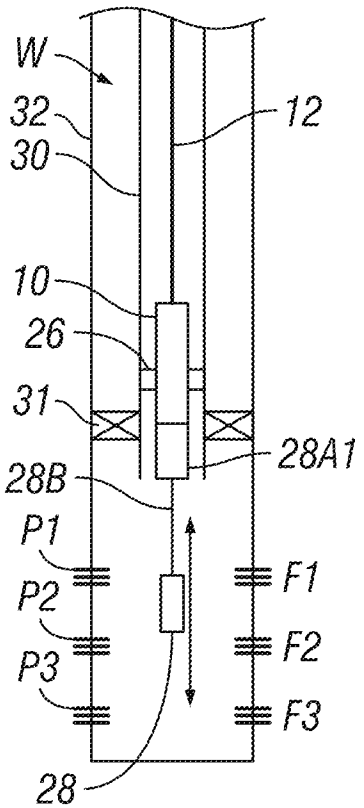

In FIG. 9, the production logging sensors 28 have been moved upwardly by operating the winch or spool 28A1 to retract the extension line 28B until the production logging sensors 28 are positioned proximate to (e.g., just above) the intermediate perforations P2. The production logging sensors 28 may be operated to obtain measurements as explained with reference to FIG. 5.

Figure 10:
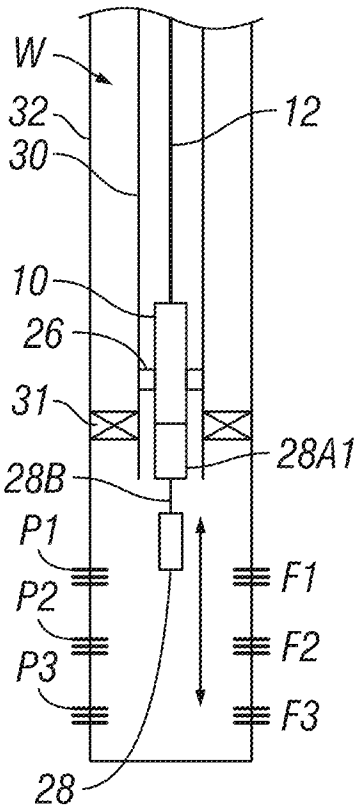
FIGS. 7 through 10 show another example embodiment of a pump and production logging tool apparatus being deployed in a well to both pump the well and to characterize fluid flow from longitudinally spaced apart zones in communication with the well.

In FIG. 10, the production logging sensors 28 have been moved upwardly by operating the winch or spool 28A1 to retract the extension line 28B until the production logging sensors 28 are positioned proximate to (e.g., just above) the shallowest perforations P1. The production logging sensors 28 may be operated to obtain measurements as explained with reference to FIG. 6.

It will be appreciated that in the present example embodiment, because the resettable packer 26 is not required to be retracted because the assembly 10 is not moved within the well W, the pump (22 in FIG. 1) may remain switched on during the entire sequence of events explained with reference to FIGS. 8, 9 and 10. Such may provide better measurements from the production logging sensors 28 than may be obtainable performing the acts explained with reference to FIGS. 4 through 6 wherein a fixed length extension line is used.

Figure 11:
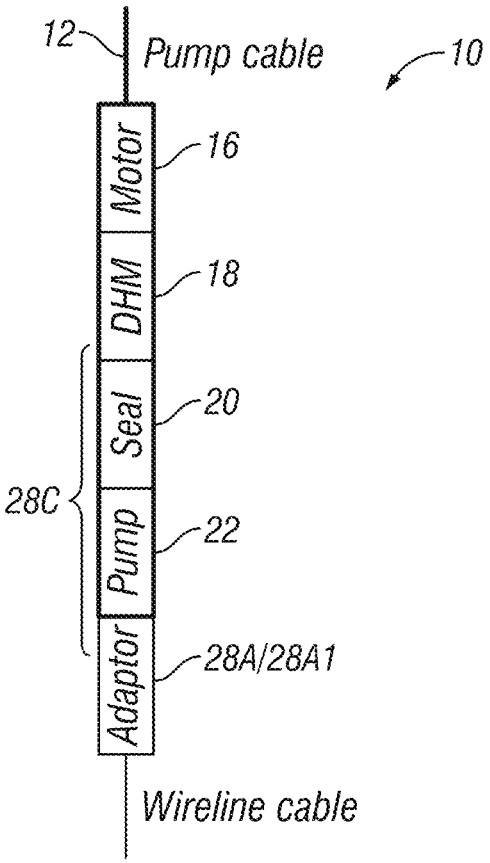
FIG. 11 shows an example embodiment of an electrical connection between a production logging tool and a downhole monitoring system associated with an electric submersible pump in order to provide power to and communicate signals from the production logging tool to surface.

FIG. 11 shows an example embodiment of an electrical connection between production logging sensors (28 in FIG. 1) and a sensor package 18 associated with an electric submersible pump 22 in order to provide power to and communicate signals between the production logging sensors 28 and the surface. The assembly 10 may comprise, as explained with reference to FIG. 1, an electric motor 16 such as a permanent magnet motor rotationally coupled, through a protector assembly 20 and a sensor package 18 to a pump 22 such as a centrifugal pump. A sensor package 18 may comprise sensors and telemetry devices (not shown separately) for measuring parameters associated with operation of the pump 22, such as pump rotational speed, electric motor 16 current draw, fluid temperature, and fluid pressure, and for communicating such measurements to the surface system (VFD 51 in FIG. 1). Electrical connection between the sensor package 18 and the production logging sensors (28 in FIG. 1) may be made, for example, using a selected length of electrical cable such as armored electrical cable or tubing encapsulated cable (connector cable for convenience) 28C extending from the sensor package 18 to the adapter 28A, or the winch 28A1 as may be the case in any particular embodiment. In such embodiments, the resettable packer (26 in FIG. 10) may comprise an electrical feedthrough (not shown) to enable the resettable packer to seal the annular space between the production tubing (30 in FIG. 10) and the protective pipe (32 in FIG. 10) while the connector cable 28C maintains the described electrical connection.

In some embodiments, the production logging sensors explained above may be substituted by sensors forming part of or associated with an optical fiber. Optical fibers may include, without limitation, longitudinally distributed sensors such as temperature and/or pressure sensors, such as Bragg gratings and coils of fiber wound around a pressure responsive core or spool. In some embodiments, optical communication between such sensors and the surface may be provided by including at least one optical fiber in the electrical cable (12 in FIG. 1). In some embodiments, and as described with reference to FIG. 11, the cable 28C extending from the sensor package 18 to the adapter 28A, or the winch 28A1 as may be the case, may comprise one or more optical fibers.

Figures 12, 13, 14, 15:
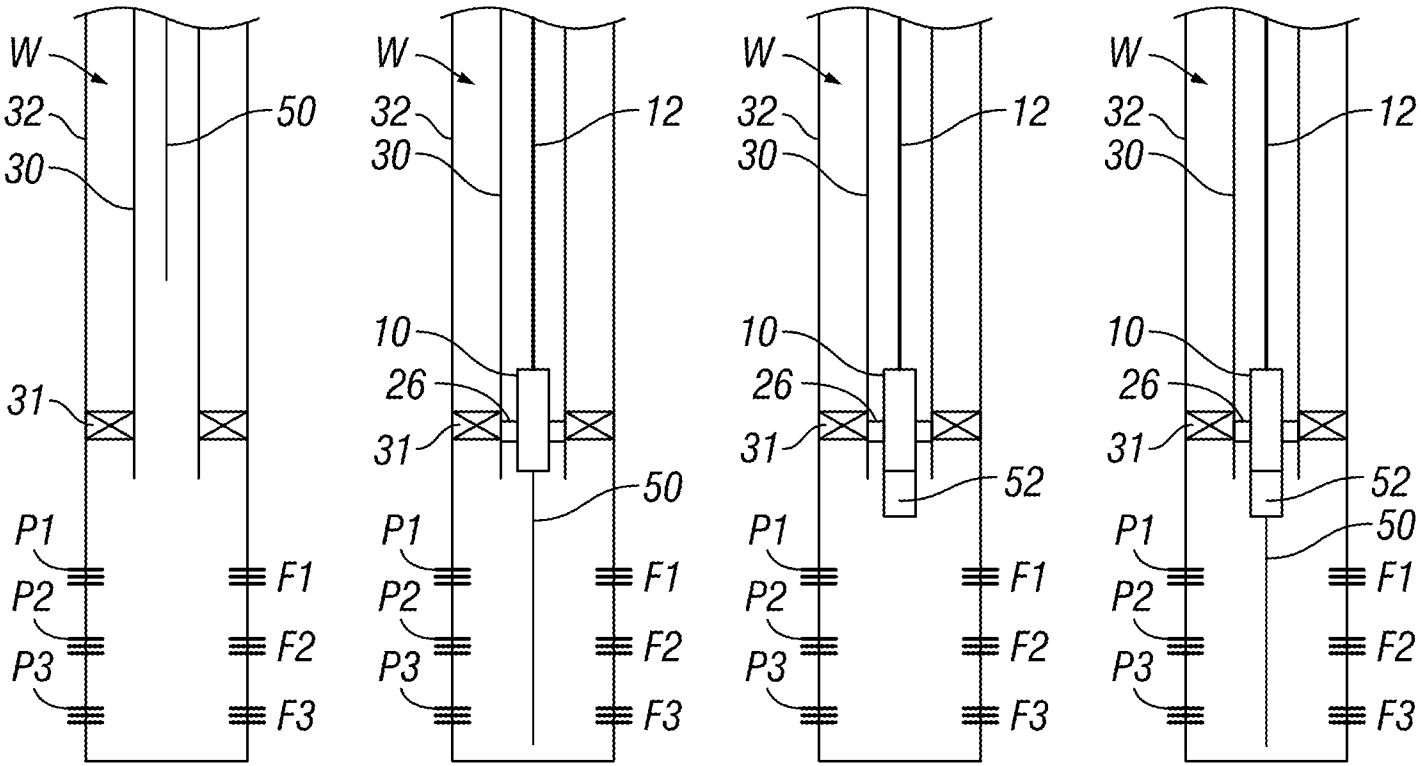
FIGS. 12 and 13 show an example embodiment of a pump and optical fiber sensor(s) being deployed in a well to both pump the well and to characterize fluid flow from longitudinally spaced apart zones in communication with the well.
FIGS. 14 and 15 show another example embodiment of a pump and optical fiber sensor(s) being deployed in a well to both pump the well and to characterize fluid flow from longitudinally spaced apart zones in communication with the well.

FIGS. 12 and 13 show an example embodiment of a pump and optical fiber sensor(s) being deployed in a well to both pump the well and to characterize fluid flow from longitudinally spaced apart zones in communication with the well. The extension line (28B in FIG. 1) in such embodiments may be or include an optical fiber, shown at 50 in FIGS. 12 through 15. In FIG. 12, a length of optical fiber 50 is shown being moved into the well W. The optical fiber 50 may be connected to the bottom of the assembly (10 in FIG. 13) and its length may be chosen such that when the assembly (10 in FIG. 13) is moved to its predetermined longitudinal position in the well W, sensing elements (not shown separately) in the optical fiber 50 are disposed in desired positions within the well below the bottom of the production tubing 30. Such positions may comprise, for example and without limitation, being disposed adjacent to perforations P1, P2, P3 hydraulically connecting formations or zones F1, F2, F3 to the interior of the casing or protective pipe 32. FIG. 13 shows the assembly 10 disposed in the predetermined longitudinal position in the well W, wherein the optical fiber 50 is disposed as explained above.

FIGS. 14 and 15 show another example embodiment of a pump and optical fiber sensor(s) being deployed in a well W to both pump the well and to characterize fluid flow from longitudinally spaced apart zones in communication with the well. In FIG. 14, the assembly 10, as explained with reference to FIG. 1, may have coupled to a bottom end thereof an optical fiber spooling unit ("launcher") 52 having wound thereon an optical fiber (see FIG. 15). The assembly 10 is moved into the well to a selected depth as explained with reference to, e.g., FIG. 1, and the resettable packer 26 is set. An example embodiment of an optical fiber spooling device may be one sold under the trade name FLI FIBER LINE INTERVENTION by Well-SENSE, Wellheads Crescent, Wellheads Industrial Estate, Dyce, Aberdeen, AB21 7GA, United Kingdom. In FIG. 15, the launcher 52 may be operated to extend the optical fiber 50 to a selected depth below the launcher 52, which selected depth may be at least to the depth of the lowermost perforations P3 or formation F3 in the well W. In some embodiments, the optical fiber 50 may comprise distributed temperature and acoustic sensors (not shown separately), measurements from which may be used to characterize fluid entering the well W (e.g., through the perforations P1, P2, P3 in the casing or protective pipe 32). In some embodiments, one or more sensors (not shown) disposed on or along the optical fiber 50 may make measurements at one particular location along the optical fiber 50, wherein the optical fiber 50 may be moved (withdrawn or extended) by the launcher 52 in order to obtain measurements related to any one or more of the formations or zones F1, F2, F3 penetrated by the well W.

A method and apparatus for lifting fluid from a well using a pump and making production logging measurements at the same time may provide well operators with an efficient procedure for characterizing which formations and or zones in a subsurface well contribute to economically useful fluid production (e.g., oil and gas) and which contribute fluids such as water, that may hinder production of useful fluids and/or require additional facilities and/or expense to handle at the surface.

In light of the principles and example embodiments described and illustrated herein, it will be recognized that the example embodiments can be modified in arrangement and detail without departing from such principles. The foregoing discussion has focused on specific embodiments, but other configurations are also contemplated. In particular, even though expressions such as in "an embodiment," or the like are used herein, these phrases are meant to generally reference embodiment possibilities, and are not intended to limit the disclosure to particular embodiment configurations. As used herein, these terms may reference the same or different embodiments that are combinable into other embodiments. As a rule, any embodiment referenced herein is freely combinable with any one or more of the other embodiments referenced herein, and any number of features of different embodiments are combinable with one another, unless indicated otherwise. Although only a few examples have been described in detail above, those skilled in the art will readily appreciate that many modifications are possible within the scope of the described examples. Accordingly, all such modifications are intended to be included within the scope of this disclosure as defined in the following claims.

What is claimed is:

1. A method for characterizing fluid production into a well during pumping fluid from the well, comprising:

deploying a well pump on an electrical cable to a first selected depth in a production tubing nested within a protective pipe in the well, the well pump having suspended therefrom an extension line, the extension line in communication with at least one production logging sensor, the extension line having a fixed length, the at least one production logging sensor supported by the extension line and disposed in the protective pipe below a bottom of the production tubing;

engaging a resettable annular seal between the well pump and the production tubing at the first selected depth;

operating the well pump at the first selected depth;

while operating the well pump at the first selected depth, measuring at least one property of fluid entering the protective pipe using the at least one production logging sensor;

switching the well pump off;

releasing the resettable annular seal from the production tubing;

moving the well pump to a second selected depth in the production tubing, the moving of the well pump causing re-positioning of the at least one production logging sensor;

re-engaging the resettable annular seal between the well pump and the production tubing at the second selected depth;

operating the well pump at the second selected depth;

while operating the well pump at the second selected depth, measuring the at least one property of the fluid entering the protective pipe using the at least one production logging sensor; and repeatedly positioning the at least one production logging sensor proximate to each of a plurality of longitudinally spaced apart sets of perforations in the protective pipe, and measuring the at least one property of fluid entering the protective pipe through each set of perforations, wherein each set of perforations is in hydraulic communication with a different formation or zone penetrated by the well, wherein engaging the resettable annular seal between the well pump and the production tubing comprises unspooling the electrical cable from a winch such that a weight of the well pump is applied to activate a seal element of the resettable annular seal, and wherein the resettable annular seal is configured to resist bi-directional forces along the production tubing, and wherein deploying the well pump at the first selected depth further comprises engaging gripping elements of the resettable annular seal against an interior of the production tubing to prevent upthrust on the well pump caused by fluid pressure.

2. The method of claim 1 wherein the at least one production logging sensor comprises a flow meter.

3. The method of claim 1 wherein the at least one production logging sensor comprises a holdup meter.

4. The method of claim 1 wherein the first selected depth and a length of the extension line are chosen such that the at least one production logging sensor is located above a set of perforations of the plurality of longitudinally spaced apart sets of perforations in the protective pipe.

5. The method of claim 1 wherein the extension line comprises an optical fiber.

6. The method of claim 5 wherein the at least one production logging sensor comprises a temperature sensor and/or an acoustic sensor forming part of or associated with the optical fiber.

7. The method of claim 5 wherein the at least one production logging sensor comprises a distributed acoustic sensor and/or distributed temperature sensor forming part of the optical fiber.

* * * * *